United States Patent [19]

Avins

[11] 4,076,367

[45] Feb. 28, 1978

[54] SOLDERLESS CONNECTOR

[75] Inventor: Jules Avins, Staten Island, N.Y.

[73] Assignee: Avins Industrial Products Corporation, Staten Island, N.Y.

[21] Appl. No.: 721,872

[22] Filed: Sep. 9, 1976

[51] Int. Cl.[2] ..... H01R 17/18

[52] U.S. Cl. ..... 339/177 E

[58] Field of Search ..... 339/177 R, 177 E

[56] References Cited

U.S. PATENT DOCUMENTS

| | | | |
|---|---|---|---|
| 3,297,979 | 1/1967 | O'Keefe et al. | 339/177 R |
| 3,465,281 | 9/1969 | Florer | 339/177 R |
| 3,634,815 | 1/1972 | Hubbard et al. | 339/177 E |

*Primary Examiner*—Gerald A. Dost

*Attorney, Agent, or Firm*—Price, Heneveld, Huizenga & Cooper

[57] ABSTRACT

A solderless connector for RF coaxial cables includes a body through which the center conductor extends and terminates in a tip insulatively mounted to the body which also receives an adapter plug having a ferrule rotatably mounted thereto and engaging the body to secure the braided shield of the coaxial cable to the body. A set screw extends radially into the adapter plug for engaging the exterior of the coaxial cable thereby preventing the inadvertent removal of the cable from the connector and increasing the mechanical strength of the coupling. A connector nut extends over the body and is adapted to couple the male connector to a corresponding female jack.

15 Claims, 3 Drawing Figures

SOLDERLESS CONNECTOR

BACKGROUND OF THE INVENTION

The present invention relates to a coaxial connector and in particular to an improved structure for electrically and mechanically coupling a coaxial cable to such connector.

Low power radio transmitters such as employed in the CB field employ for transmission lines relatively small diameter coaxial cables such as the standard commercially available RG-58/U. In order to couple the transmission line to a transmitter, frequently the interconnection of which is at the rear of the unit, a standard size coaxial connector is desirable to provide the necessary mechanical strength and ease of installation. The commercially available standard size coaxial connectors such as military-type UG-111/U cannot accommodate the smaller diameter transmission lines frequently in use without the utilization of an adapter plug for the connector body. Adapters commercially available for such units provide a rotating contact engaging the braided shield of the coaxial connector and as the unit is assembled such rotation against the stationary connector body tends to shear the braided shield frequently causing an electrical open circuit either continuous or intermittently when the cable is moved. Such commercially available type connectors also do not provide means for anchoring the cable to the adapter, thus further promoting the fracture of the braided shield.

Other connectors commonly attached to packaged CB antennas are permanently affixed by special crimping tools and although such connectors have proven useful, they do not permit removal of the cable therefrom for changing the length of the transmission line or its replacement nor can the connection of the cable therein be repaired should a failure occur. Additionally, if the transmission line must extend through the car's body or firewall, the installer must drill relatively large holes, possibly through several locations to accommodate the permanently crimped connector. This is both difficult and undesirable partly since there may be an access problem. Also a do-it-yourselfer may not have the drill size readily available and frequently does not want to drill large holes in a new vehicle.

In order to provide good electrical and mechanical contact between a braided coaxial cable and an associated connector, frequently it is necessary with prior art connectors to solder the braid to the mating sleeve of the connector as well as soldering the center conductor to the tip of the connector. Such requirements naturally make the use of this type of connector significantly more difficult for those unskilled in proper electrical soldering techniques which typifies many engaged in citizen band radio installation and use.

Accordingly, there exists a great need for an improved coaxial connector having the desirable relatively large size for ease of coupling and rigid mechanical strength required in vehicles subject to vibration and shock and yet a connector which can provide excellent mechanical and electrical contact. The need extends to a connector which can be used for coupling a relatively small diameter coaxial cable to the relatively large connector without the utilization of any soldering steps or specialized tools and which does not require the drilling of large holes through the vehicle.

SUMMARY OF THE INVENTION

The present invention satisfies these requirements by providing a solderless connector having a body through which the center conductor of the coaxial cable extends in insulative relationship thereto and terminates in the tip. An adapter plug having an aperture for snugly receiving a relatively small diameter coaxial cable is provided with a rotatable ferrule and is threadably fitted into the body of the connector such that the shielded braid extends between the body and the ferrule and remains stationary as the adapter is secured to the body by tightening with a rotational motion. In some embodiments the adapter further includes a radially extending threaded aperture for receiving a set screw secured to the outer insulator of the coaxial cable to provide a rigid mechanical connection between the connector and the cable near the end of the connector. A threaded nut fits over the body of the connector for securing it to a corresponding connector.

The connector so formed provides solderless interconnection of a coaxial cable to the connector while preventing the breakage of the shield during the assembly of the cable to the connector. It also provides rigid mechanical attachment of the cable within the connector preventing removal of the cable from the connector and reducing and virtually eliminating intermittent electrical open circuits caused by mechanical vibrations. Such unit is relatively easy for those unskilled in the electrical arts to employ and provides superior performance as compared to existing commercial connectors. These and other features, advantages and objects of the present invention will become readily apparent upon reading the following description thereof in conjunction with the accompanying drawings in which:

DETAILED DESCRIPTION OF THE PREFERRED EMBODIMENT

Figure 1:
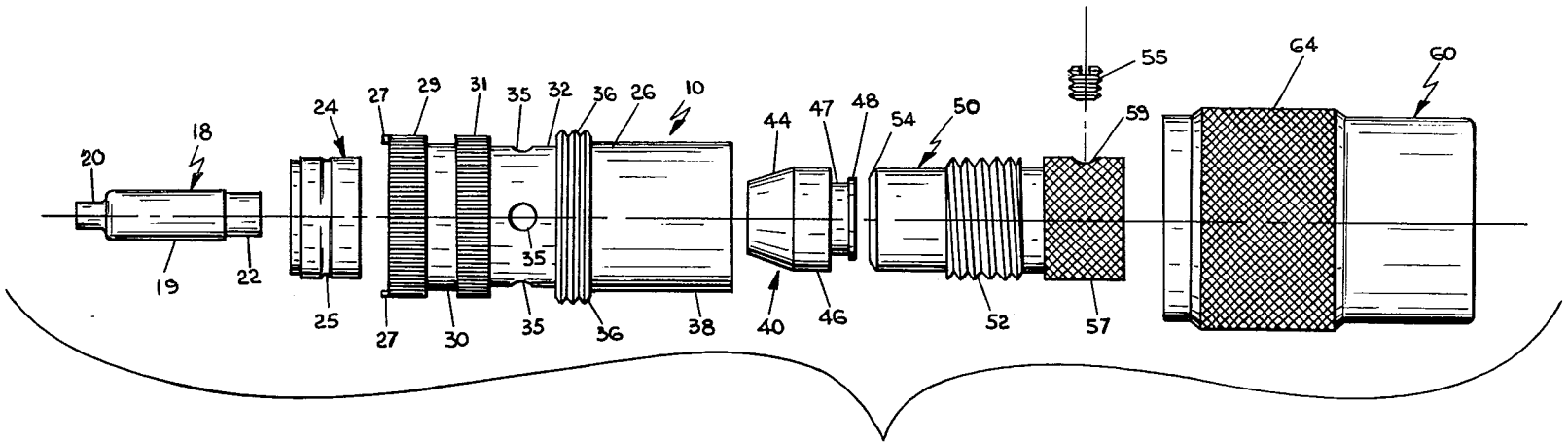
FIG. 1 is an enlarged exploded view of one embodiment of a connector embodying the present invention.
Figure 2:
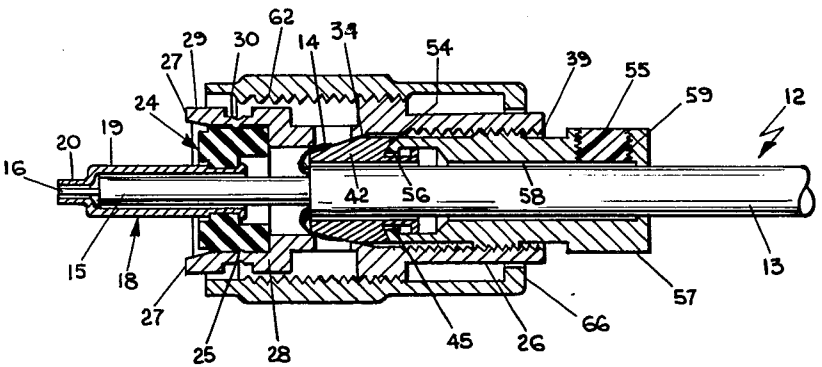
FIG. 2 is a cross-sectional view of the assembled connector shown in FIG. 1 together with a coaxial cable secured therein.

Referring initially to FIGS. 1 and 2 there is shown a male coaxial connector 10 particularly adapted for use with an RG-58/U coaxial cable 12. Cable 12 is the type typically used for transmission lines in CB radios. Cable 12 includes an outer insulating jacket 13, an underlying braided shield or outer conductor 14 an annular coaxial insulating layer 15 and a center conductor 16. Connector 10 includes a tip 18 having an enlarged body portion 19, a reduced diameter tip 20 and a cylindrical insert 22 which is fitted within a generally circular insulator 24. Insulator 24 has a central aperture for snugly receiving projection 22 which is then staked at its right end (as seen in FIG. 2) for securely holding tip 18 to insulator 24.

The hollow generally cylindrical section 19 has an inner diameter sufficiently large to permit insulator 15 to extend therein as shown in FIG. 2. The insulation is stripped at the wires end exposing center conductor 16 which fits within the narrowed tip 20 having an inner diameter providing a close fit between wire 16 and the tip. Inasmuch as the tip is significantly smaller in diameter than segment 19 which is adapted to fit within a female coaxial connector, the tip can be secured to the coaxial cable 12 mechanically by use of simple tools such as a pair of pliers. Tip portion 20 is thus squeezed against conductor 16 thereby providing a good mechanical and electrical interconnection without interferring with the insertion of portion 19 in a socket. Naturally, if desired, the tip can be soldered although this is not required.

Before installation of the coaxial cable, insulator 24 is positioned within the body 26 of connector 10 which includes an annular recess 28 (FIG. 2) against which the rear surface of insulator 24 abuts. The generally cylindrical body 26 includes at its front end a pair of relatively small projections 27 at 180° intervals for holding the body against serrations in the female connector preventing rotation of the body once tip 18 has been inserted into the mating connector. The forward edge of body 26 includes a straight-lined knurled portion 29 and a second spaced knurled projection 31 between which there is a recessed area 30. Once insulator 24 is fitted within the end of body 26, recess 30 is roll formed to compressibly engage the outer diameter of insulator 24 and substantially deforms within an annular recess 25 surrounding the body of the insulator.

To the rear of knurled bands 29 and 31 there is provided a central cylindrical section 32 having a beveled interior surface 34 for seatably receiving a correspondingly beveled surface 44 of a ferrule 40. Section 32 may optionally include a plurality of radially extending solder apertures 35 extending through the wall and permitting, if desired, the soldering of braid 14 within the connector body, if desired. This structure and assembly step, however, is not necessary or required.

Behind section 32 of body 26 there is provided an externally threaded band 36 for threadably receiving the internally threaded connector nut 60. Behind the externally threaded segment 36 there is provided a cylindrical rear section 38 internally threaded at 39 for threadably receiving therein the cable adapter plug 50 which includes an externally threaded portion 52 for such purpose.

Ferrule 40 includes a cylindrical internal aperture 42 having an internal diameter sufficiently large to pass the insulative jacket 13 of cable 12 therethrough. Behind the beveled forward surface 44 there is a cylindrical body 46 having a diameter slightly smaller than the internal diameter of the cylindrical section 38 of body 26. The rear end of the ferrule body includes a beveled surface 45 slidably engaging beveled surface 54 of plug 50. The ferrule also includes a flange 48 extending from a narrowed cylindrical recess 47 integrally coupling flange 48 to the cylindrical body 46 of the ferrule.

Adapter plug 50 includes a roll formed circular lip 56 as best seen in FIG. 2 having an internal diameter slightly smaller than the external diameter of the cylindrical flange 48. Ferrule 40 is press-fit within plug 50 such that the lip 56 of the adapter extends into the recess 47 of the ferrule with flange 48 preventing removal of the ferrule from the adapter 50. When snapfitted into the adapter, the ferrule is free to rotate with respect to the adapter 50 as well as move axially a restricted distance defined by the width of recess 47. Such construction which provides the captive coupling of ferrule 40 to body 50, prevents loss of the ferrule during assembly of the cable to the connector and provides for free rotation of the adapter 50 with respect to the ferrule 40 during installation to prevent shearing of the braid 14 of the cable as described in greater detail below.

The generally cylindrical plug also includes an axially extending aperture 58 having a diameter permitting the insulating jacket 13 to extend therethrough. A diamond knurled enlarged cylindrical end 57 includes a radially extending threaded aperture 59 extending therethrough for receiving a set screw 55 for providing a mechanical clamping means extending between the adapter and the coaxial cable 12 preventing removal of the cable from the connector should tension be placed on the cable once it has been coupled to the connector as described more fully below.

Surrounding the body 26 of the connector is knurled nut 60 internally threaded at 62 to threadably couple the connector to a correspondingly threaded female connector. At least a portion of the exterior surface of nut 60 includes a knurled portion 64 facilitating the tightening of nut 60 onto the female connector. At the end of nut 60 there is provided an inwardly projecting flange 66 having an internal diameter sufficient to permit the nut to clear the outer diameter of connector body 26 and yet engage the rear surface 37 of threaded portion 36 of the body when the nut is tightly secured to the female connector thereby holding the connector 10 to the mating connector.

Having described the structure of connector 10, a description of the assembly of cable 12 onto the connector is now discussed. It is noted that the connector when purchased includes as an assembled unit tip 18, insulator 24 and body 26 as one unit. Similarly the adapter plug 50 and press-fit rotatable ferrule 40 together with the loosely fitted set screw 55 defines a second assembly of the connector. Finally the nut 60 is separate from the other two subassemblies. For installation, the coaxial cable is stripped at the tip to expose approximately a quarter of an inch of center conductor 16 with approximately an inch of the outer jacket being removed to expose the braided portion 14 of the cable. Nut 60 and adapter assembly 50 are then positioned over the jacket of the coaxial cable with the forward edge of ferrule 40 being aligned with the end of insulating jacket 13. The braided shield 14 of the cable is then drawn rearwardly over the beveled surface 44 of ferrule 40 and plug 50 is positioned within the body of the connector such that the center conductor 16 extends within tip 20 of the body subassembly.

Adapter 50 is then secured within the body by rotation using the knurled portion 57 for tightening the adapter within body 26. During rotation of the adapter, the ferrule compressibly engages the braid held on its opposite side by tapered surface 44 of the body and remains stationary as the adapter plug is rotated. The rotatable interconnection between ferrule 40 and adapter 50 thereby prevents rotation of the ferrule during the tightening process which could cause shredding of the braid 14 and subsequent electrical open circuiting of the coupling of the braid to the connector. Once plug 50 is securely threaded within body 26, set screw 55 can be tightened to secure the cable within the plug thereby providing stress relief for the cable with respect to the connector. Tip 20 is then pinched to securely contact center conductor 16 and nut 60 threaded over the exterior threaded portion 36 of the body completing the installation of the connector on the end of the coaxial cable 12. It is noted that each of the body members 26, ferrule 40, adapter 50 and nut 60 are made of a conductive material for electrically coupling the braid 14 held in electrical contact between ferrule 40 and body 26 to the exterior conducting portion of the corresponding female plug. Similarly, tip 18 is made of a conductive material such as brass or copper to provide electrical conduction between conductor 16 and tip 18 of connector 10. Insulator 24 naturally insulates the conductive portions of the plug preventing short circuiting between center conductor 16 and braid 14.

In the embodiment shown in FIGS. 1 and 2, once nut 60 has been threaded over the threaded section 36 of body 26, the nut 60 is captured on the body by flange 66 at one end engaging threads 36 and at the opposite end by the rear portions of threaded portion 62 engaging the front portion of threads 36 of the body. This prevents the nut from inadvertently dropping off of the remaining connector portion when the connector is disconnected from the transmitter, for example, of a CB radio.

Figure 3:
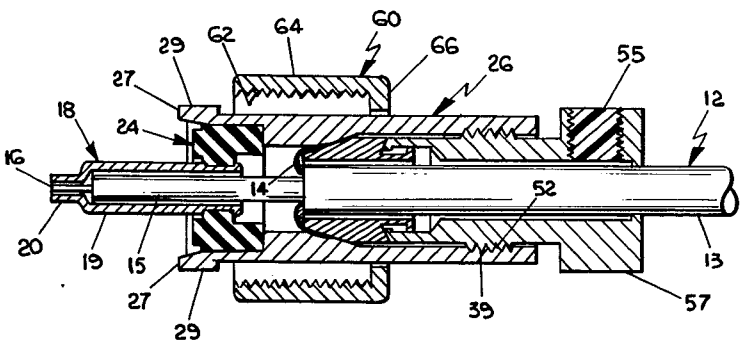
FIG. 3 is a cross-sectional view of an alternative embodiment of the present invention.

Referring now to the alternative embodiment of the invention shown in FIG. 3, corresponding elements are identified with identical reference numerals as the FIGS. 1 and 2 embodiment. In FIG. 3, connector body 26 has a smooth cylindrical outer surface with the knurled portion 57 of adapter plug 50 having an outer diameter greater than the inner diameter of flange 66 of the internally threaded nut 60. Further the body 26 includes at its forward end a knurled portion 29 having an outer diameter greater than the flange 66 of the nut thereby holding the nut between the left end of body 26 and the knurled portion 57 of the adapter 50. In this embodiment, the body assembly comprising tip 18, insulator 24 and the body 26 are preassembled in a fashion identical to that described in the FIG. 1 embodiment. Similarly, the ferrule 44 is coupled to the adapter 50 to provide for free rotation of the ferrule with respect to the body, both of which have correspondingly beveled surfaces for compressibly securing the braid 14 of the coaxial cable 12 therebetween. A set screw 55 axially extends into a threaded aperture 59 of the knurled portion 57 of adapter 50 for securing the cable to the connector thereby providing tension relief for the braid 14 and center conductor 16.

It will become apparent to those skilled in the art that various modifications to the preferred embodiments disclosed and described herein can be made. Thus, for example, the adapter plug can have an aperture selected for any desired cable diameter. Likewise as seen in FIG. 3, the body need not include soldering apertures since the connector does not require soldering of the cable thereto. The structure can be used equally for male connectors as shown or female connectors in such case tip 18 is replaced with a tip receiving socket. These and other modifications of the preferred embodiments can be made by those skilled in the art without departing from the spirit and scope of the invention as defined by the appended claims.

I claim:

1. A coaxial cable connector comprising: a conductive body, contact means for receiving the center conductor of the coaxial cable, insulating means for mounting said contact means in insulating relationship to said body, said body including seating means for the outer conductor of said coaxial cable, conductive plug means including a central aperture for receiving the cable therethrough and integrally including engaging means for freely rotatably and captively mounting a ferrule to one end thereof, means for providing a nonslip interconnection for the wire braid outer conductor of said coaxial cable to secure said outer conductor to said body including a single piece ferrule having integral means engaging said engaging means of said plug for freely rotatably and captively mounting said ferrule to said one end of said plug said ferrule including a surface for engaging the outer conductor of the cable; said body and plug including means for rotatably securing said plug in said body whereby said outer conductor is compressibly secured between said seating means and said ferrule and held stationary therebetween by said ferrule as said plug is rotatably fitted into said body; and means for coupling said body to the body of a mating connector.

2. A coaxial cable connector comprising: a conductive body, contact means for receiving the center conductor of the coaxial cable, insulating means for mounting said contact means in insulating relationship to said body, said body including seating means for the outer conductor of said coaxial cable, conductive plug means including a central aperture for receiving the cable therethrough and including a ferrule rotatably mounted at one end for engaging the outer conductor of the cable; said body and plug including means for securing said plug in said body whereby said outer conductor is compressibly secured between said seating means and said ferrule and held stationary therebetween as said plug is rotatably fitted into said body; means for coupling said body to the body of a mating connector, wherein said ferrule includes a body with an aperture aligned with said central aperture of said plug and an integral flange extending in axially spaced relationship to said body to define a recess between said flange and said body and wherein said plug includes an inwardly projecting lip extending over said flange into said recess for holding said ferrule to said plug.

3. The connector as defined in claim 2 wherein said means for securing said plug in said body comprises mating threads formed on each of said plug and said body.

4. The connector as defined in claim 3 wherein said body of said ferrule is beveled at an end remote from said flange.

5. The connector as defined in claim 4 wherein said seating means comprises a beveled surface formed in said body and shaped to conform to said beveled end of said ferrule.

6. The connector as defined in claim 1 wherein said plug further includes a radially extending threaded aperture communicating with said central aperture at an end remote from said ferrule and a set screw for mechanically securing the coaxial cable within said plug.

7. The connector as defined in claim 1 wherein said connector is a male type connector and said contact means comprises a tip projecting axially outwardly from said insulating means.

8. A coaxial connector for solderless coupling to a coaxial cable including a cylindrical conductive body including means for receiving an insulator at one end and internal thread means at the opposite end, said body internally including a circumferentially extending beveled surface between said receiving means and said thread means; an insulator mounted to said one end of said body for supporting a contact in insulative relationship to said body; a contact coupled to said insulator in axial alignment with said cylindrical body, wherein the improvement comprises: a conductive cylindrical plug and rotatable ferrule assembly insertable into said body for holding a coaxial cable therein comprising a conductive cylindrical plug including external thread means for engaging said internal thread means of said body, a central longitudinal aperture, a lip projecting inwardly from one end of said plug into said aperture to captively engage said ferrule, said ferrule including a body with a beveled surface at one end to seat with said circumferentially extending beveled surface of said connector body, said ferrule including a circumferentially extending flange spaced in axial relationship to the body of said ferrule to define an annular recess, said recess receiving said lip of said plug to secure said ferrule to said plug, said flange having an outer diameter smaller than the inner diameter of said plug to permit rotation of said ferrule with respect to said plug.

9. The connector as defined in claim 8 wherein said plug includes a radially extending threaded aperture communicating with said central aperture and a set screw for securing a coaxial cable to said plug.

10. A solderless coaxial cable connector comprising:

a conductive cylindrical body including internal thread means at one end and a circumferentially extending internal beveled surface for receiving the outer conductor of a coaxial cable;

insulator means fitted in said body at an opposite end thereof;

a conductive cylindrical tip for receiving the center conductor of a coaxial cable, said tip including a narrowed end portion adapted for crimping said tip to the center conductor, said tip mounted to said insulator in axial alignment with said body;

a conductive cylindrical plug including a central aperture for receiving a coaxial cable, said plug including external thread means for engaging said internal thread means of said body and a circumferentially extending inwardly projecting lip at one end;

a conductive ferrule rotatably and captively held to said plug by said lip, said ferrule comprising a body having one end beveled for mating engagement with said beveled surface of said body for holding the outer connector of a coaxial cable therebetween, a flange extending from the opposite end of said ferrule body in axially spaced relationship to said ferrule body to define a recess between said flange and said ferrule body whereby said lip of said plug extends over said flange into said recess for holding said ferrule to said plug and permit relative rotation therebetween; and a cylindrical conductive nut surrounding said body for coupling said body to a mating connector.

11. The connector as defined in claim 10 wherein said plug further includes a radially extending threaded aperture communicating with said central aperture at an end remote from said ferrule and a set screw for mechanically securing the coaxial cable within said plug.

12. The connector as defined in claim 11 wherein said connector is a male type connector and said contact means comprises a tip projecting axially outwardly from said insulating means.

13. The connector as defined in claim 12 and further including means cooperating between said nut and said body for captively holding said nut to said body.

14. The connector as defined in claim 12 wherein said nut includes an inwardly projecting lip and said plug and said body each includes an enlarged end for captively holding said nut to said body.

15. The connector as defined in claim 12 wherein said body, said ferrule, said plug and said nut are made of brass.

* * * * *

UNITED STATES PATENT AND TRADEMARK OFFICE

CERTIFICATE OF CORRECTION

PATENT NO. : 4,076,367

DATED : February 28, 1978

INVENTOR(S) : Jules Avins

It is certified that error appears in the above-identified patent and that said Letters Patent are hereby corrected as shown below:

Column 5; line 56:

"I claim:" should be --The embodiments of the invention in which an exclusive property or privilege is claimed are defined as follows.--

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*